United States Patent [19]

Knutson et al.

[11] Patent Number: 4,944,258

[45] Date of Patent: Jul. 31, 1990

[54] OPERATOR PROTECTION FOR HIGH PRESSURE HOSE MACHINES

[75] Inventors: Robert D. Knutson, Oconomowoc; Bruce Boczkiewicz, Mukwonago; James C. Wurster, Pewaukee, all of Wis.

[73] Assignee: Super Products Corporation, New Berlin, Wis.

[21] Appl. No.: 340,899

[22] Filed: Apr. 17, 1989

[51] Int. Cl.[5] ..... B08B 3/02

[52] U.S. Cl. ..... 134/167 C; 134/168 C; 134/169 C; 134/199; 134/172; 137/355.12

[58] Field of Search ..... 134/166 C, 167 C, 168 C, 134/169 C, 199, 180, 172; 15/414, 302, 315; 137/355.12; 239/169, 175

[56] References Cited

U.S. PATENT DOCUMENTS

| | | | |
|---|---|---|---|
| 3,370,599 | 2/1968 | Ciacco | 134/167 C |
| 3,866,679 | 2/1975 | Laky | 134/167 C X |
| 3,910,447 | 10/1975 | Manor | 134/168 C X |
| 3,959,840 | 6/1976 | Sato | 134/167 C X |
| 4,134,174 | 1/1979 | Flynn et al. . | |
| 4,234,980 | 11/1980 | DiVito et al. | 15/353 X |
| 4,669,145 | 6/1987 | Kehr | 134/166 C |
| 4,838,302 | 6/1989 | Prange . | |

OTHER PUBLICATIONS

"Camel" brochure of Super Products.

"Camel Jet" brochure of Super Products, No. M/AZ/4/88/8M.

SRECO bulletin 3000 by Sewer Rodding Equipment Company, No. 3000/SM.

"Safe-Way" by SRECO/Flexible Sewer Rodding Equipment Company, No. 3045/87.

"SR 4000" bulletin by Underground, Inc.

*Primary Examiner*—Frankie L. Stinson

*Attorney, Agent, or Firm*—Foley & Lardner

[57] ABSTRACT

An operator protection device for use in connection with the operation of a sewer and/or catch basin cleaner containing a pressurized water hose, wherein the device comprises a first protective enclosure portion and a second enclosure member comprising a tubular sleeve of tough, flexible material slidably containing an exposed portion of the pressurized hose for protection of the lower extremities of an operator in the event of hose rupture or disconnection of a coupling member used to join sections of the pressurized water hose, and for ease in access and visiblity to the sewer and/or catch basin.

14 Claims, 2 Drawing Sheets

OPERATOR PROTECTION FOR HIGH PRESSURE HOSE MACHINES

BACKGROUND OF THE INVENTION

1. Field of the Invention

The present invention relates generally to the field of preventing injury to the operator of machinery which includes a hose through which a fluid is pumped under high pressure. More specifically and in the preferred embodiment, the invention relates to the protection of operators of high pressure and high velocity sewer cleaning equipment which uses high pressure water jetting for the cleaning of sewer laterals.

2. Description of the Prior Art

Several types of sewer and catch basin cleaning machines are available on the market. Two types of such machines are manufactured by the assignee of the present invention, including the CAMEL® machines which include sewer and catch basin cleaners and the "CAMEL® JET" machines which are principally used for sewer cleaning without catch basin vacuuming.

In both types of machines, a hose reel is provided for containing up to 800 feet or more of a hose through which water is pumped at high pressure during the sewer cleaning operation. Pressures as high as 2500 psi or more are utilized with a jetting nozzle having reverse nozzle openings which, in effect drive the nozzle into the sewer lateral pulling hose behind. The nozzles create a cutting and loosening action within the sewer laterals so that debris is loosened and carried by water flow to a catch basin or manhole. In those machines including vacuum systems, a vacuum hose may be located on a hydraulic boom for removing material, including material removed from the laterals into a debris tank loaded on the truck mounted machine. A machine of this nature is disclosed in the Wurster, et al U.S. Pat. No. 4,134,174 entitled "Sewer And Catch Basin Cleaner", issued on Jan. 16, 1979. This patent also discloses and claims modern machines which include water circulation systems to allow purification of the water collected in a debris tank for reuse in a water jetting operation.

The hose reel in the aforementioned type of equipment may be mounted within an open area behind the truck cab or even in front of the truck, depending on the desired end use for the machine. In both cases, the hose reels are hydraulically driven to wind the hose onto the reel after the jetting procedures have unwound the hose. Pulling the hose against the pressure of the jetting nozzle adds to the effectiveness of the lateral cleaning operation. Another type of machine is the "CAMEL® JET" which does not include the vacuum system but does include the hose reel and high pressure jetting equipment described above. In this particular machine, the hose reel is mounted with its axis perpendicular to the axis of the truck and aligned so that the hose is unwound at the rear of the truck body. It should be understood that the reel may also be positioned in front of the chassis if desired. A lever, known as a level winder, is provided for steering the hose in order to help wind the hose on a reel and further to assist in aligning the hose with the entrance to a catch basin or manhole, and into a sewer lateral.

One of the significant problems associated with the use of this type of equipment is the potential for operator injury in the event that the high pressure hose were to burst or a repair coupling were to come loose during use. Concerning the latter situation, newly supplied hoses are continuous, without interruption throughout their length. However, it is quite common practice to utilize repair couplings in areas where a hose later becomes abraded due to usage under relatively deleterious working conditions, or is cut or otherwise damaged. The hoses are repaired by severing to remove the damaged area and reconnected with the use of repair couplings. Until recently, there were no standards or standardized methods for repairing or testing damaged sewer hose or couplings for sewer hose even now only a voluntary standard exists are published by the National Solid Waste Management Association. Invariably, an operator must stand relatively close reel and catch basin or manhole for normal operation. The operator needs to visually look into the manhole for guiding the hose into the sewer lateral. This is also true where a vacuum hose is used in conjunction with a high pressure hose. A vacuum hose is generally supported from a separate boom, or by other means. Thus, visibility of the catch basin or manhole will become particularly vital during the initial set up and during retrieval of the high pressure hose nozzle and/or vacuum hose. In such cases, it is obvious that an operator will need an access to the manhole and must position himself in the proximity of both hoses. The problem is particularly troublesome if the hose were to burst or a coupling were to fail at the area between the hose reel and the location where the hose enters the manhole. Here, the end of the hose can fly wildly about under the high pressure typically utilized, creating risk of injury by the end of the hose or coupling and by the high powered water spray. Damage to the hose itself occurs through the lifetime of the equipment as the hose encounters potentially sharp obstacles within the sewer lateral, rocks, roots, etc. Obviously, damage to the hose because of such deleterious action require repair couplings to be installed regularly in the field.

The general problem has been recognized since at least 1984 by the assignee of the present invention, and as illustrated in one of its brochures published about that time, a transparent shield was provided around the upper approximately 90° of the hose reel in the general vicinity of where an operator would stand.

Another type of high velocity sewer flushing machines are made by Sreco as described in its product bulletins 3000 and 3045. The latter product bulletin describes the SAFE-WAY® machine, which includes a cabinet extending from the rear of the truck in the vicinity of the hose reel. The cabinet includes components which are assembled on site and a clear shatterproof view window so that the hose can be seen from the control panel area. The cabinet is spaced above the roadway so that the hose can be seen below the level of the cabinet, several inches above the manhole rim. The device is relatively cumbersome to use and disassembled and reassembled as the sewer flushing equipment is moved from job site to job site. In addition, it is difficult to manipulate the hose when it is fed through the elongate compartment.

It will be observed from the photograph of these prior art brochures that the prior device must be used on a relatively level area and that there is little or no available entry of a vacuum hose. The lowermost shield also requires relatively cumbersome disassembly when the truck or trailer is moved from one location to another. It is necessary to use mirrors (not shown in product bulletins) to see into the manhole. It is also possible during operation, that the pressure hose may be moved very close to the operator with a portion exposed between the lowermost part of the shield and the street level. This may occur as the hose is unwound and moves across the reel towards the operator during the winding and unwinding operation.

Another device providing shielding means for the upper portion of a high pressure hose is shown in the attached advertisement of Underground, Inc. Here, a catch basin or manhole cleaner is supported by a mobile trailer. It is to be noted that no protection is provided between the lowermost marginal edge of the shielding housing and the catch basin or manhole.

A containment system which would prevent operator injury and permit hose manipulation and which otherwise overcomes the shortcomings of the devices of the prior art would represent a significant advance in this technology.

SUMMARY OF THE INVENTION

It is a principal object of the present invention to provide an operator protection - hose containment system for machines which include a hose through which fluids are pumped under pressure.

Another object of the present invention is to provide a containment system for the hose of sewer cleaning machines which include a hose reel and a hose through which water is pumped under high pressure.

A still further object of the present invention is to provide a transparent shield which is easy to manufacture and install on sewer cleaning machines and which will permit viewing of the hose as it is wound and unwound from the hose reel and provide a full, unobstructed view of the manhole or catch basin.

A different object of the present invention is to provide a hose manipulation device having a depending containment tube for containing the hose between the shield portion of the device and the manhole rim.

A still further object of the present invention is to provide a containment and safety system which may be used with presently existing equipment without the need for substantial equipment redesign.

Yet another object of the present invention is to provide a containment system which is light in weight and easy to assemble at a job site.

How these and other objects of the present invention are accomplished will be described in the following detailed description of the preferred embodiment, taken in conjunction with the drawings. Generally, however, the objects are accomplished by providing a transparent, shatter-proof shield which is adapted to generally surround the area of the hose reel to which the operator would be exposed during normal operation of a sewer cleaning machine or other type of machine involving a hose under which fluids are pumped at high pressure.

The transparent portion may be rigidly affixed to the machine or slidable from a storage position to an operating position depending on overall machine design. A manipulation tool, commonly known as a "level winder", may be provided generally adjacent the lower end of the transparent shield, from which a containment tube depends. The containment tube may be made of a low friction, smooth bored, flexible plastic or rubber tube or the like. Also, it should preferably be water resistant and be able to withstand forces exerted by a pressure hose rupturing or coupling failure on portions of the pressure hose contained within the tube. The level winder is not always required, but when present, should the hose rupture above the level of this manipulation tool, the operator would be protected by the transparent shield. Should the hose rupture within the tube, the containment tube would protect the lower portion of the body of the operator.

The present invention further contemplates utilizing a containment tube without use of a protective shield, but with the tube extending upwardly as shown in FIGS. 1 and 2 within the proximity of the highest point of entry of the high pressure tube from the reel and with the containment tube extending downwardly therefrom and into the manhole or catch basin a sufficient length for operator protection. It will be noted from the aforementioned CAMEL® brochure that the photographs directed to the CAMEL® Super 200 and Super 300, that there was previously provided a flexible, corrugated tube for receiving the high pressure hose. That tube was supported at its upper end by stationary support means and extended only down to slightly above the bumper of the truck chassis. The tube provided dual functions of guiding hose drippings away from the surroundings as the hose is retracted from the manhole or catch basin, as well as providing a degree of protection for the operator.

The disclosed operator protection device of the present invention not only permits head-to-toe protection of an operator, but further permits visibility for handling of a vacuum hose or a pressure hose, and at the same time permits sufficient space for access to the manhole and insertion of a vacuum hose along with the pressure hose as is often required.

Further details as to how the objects of the present invention are accomplished will become apparent to those skilled in the art after reading the following description of the preferred embodiment.

DESCRIPTION OF THE PREFERRED EMBODIMENT

With reference to the drawings, there is disclosed a sewer and catch basin cleaner 10 which may be mounted on the chassis of truck 11, but it should be noted that the cleaner 10 may also be mounted on a trailer, or skid mounted, or it could be self-propelled, e.g. on a crawler tractor (not shown). Because of these various modifications, the description of the present invention in connection with a truck mounting should be taken as illustrative rather than limiting.

Figure 1:
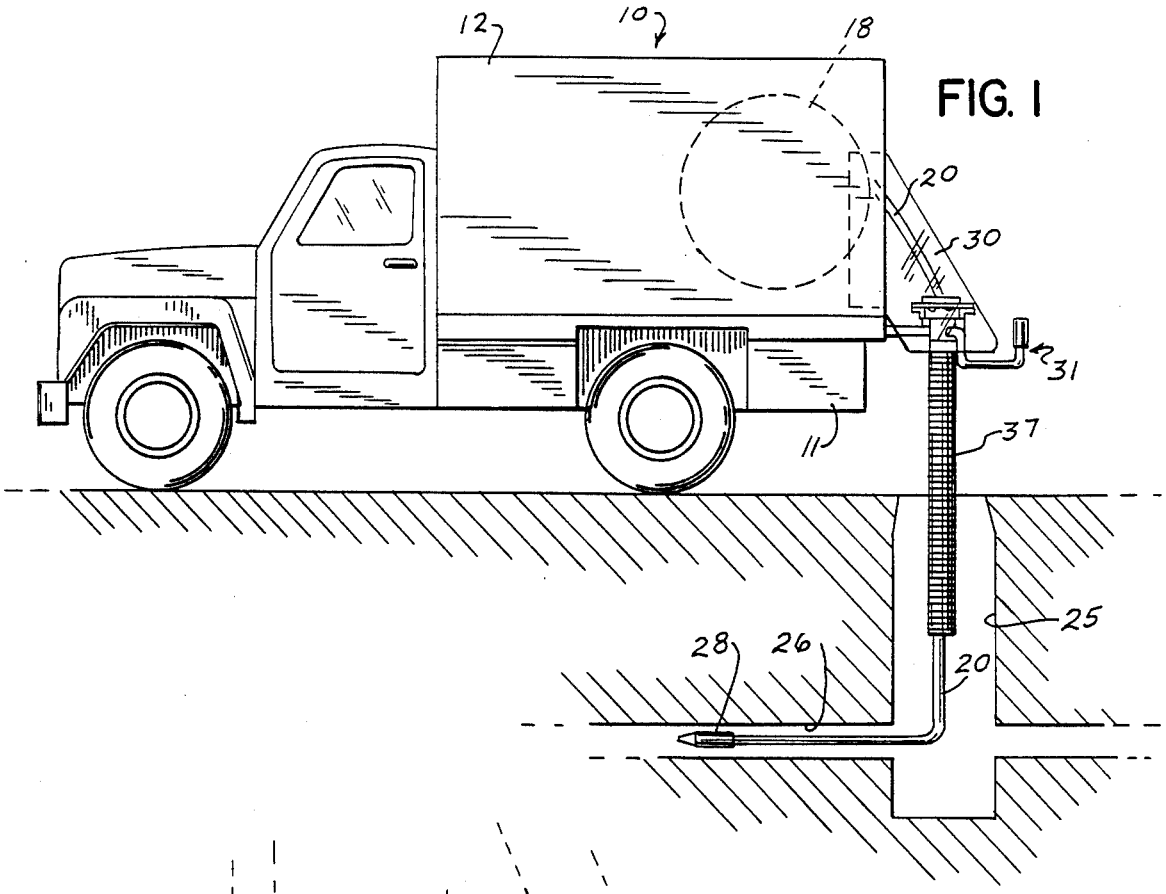
FIG. 1 is a side elevational view of a sewer cleaner mounted on a truck according to a preferred embodiment of the present invention.

With reference to FIG. 1, the cleaner 10 includes a water tank 12, which is preferably constructed from rib-reinforced sheet steel so that it can withstand loading with water, a water pump (not shown) and a hose reel 18 with a water hose 20 coiled on and supported by the reel 18.

The cleaner 10 may also include a material collection body (not shown). For purposes of simplicity in drawing and in description, the usual vacuum intake or collection hose has not been shown. Details of a typical cleaner in which the invention may be incorporated is disclosed in the aforementioned U.S. Pat. No. 4,134,174.

Figure 2:
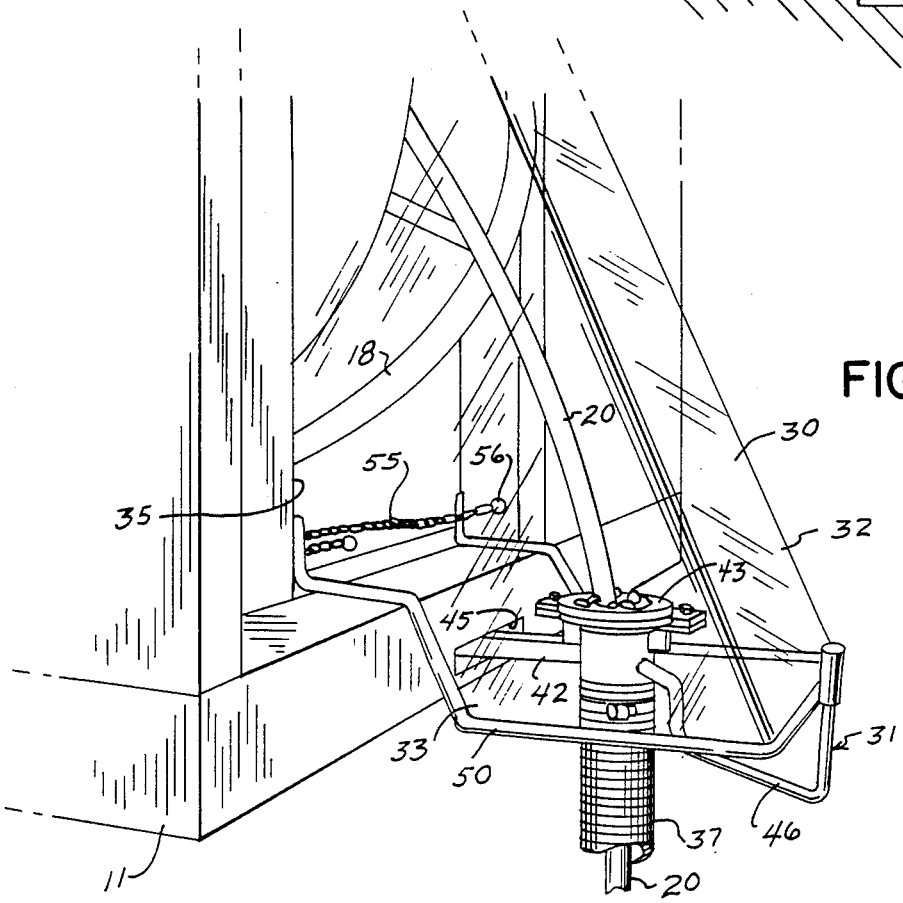
FIG. 2 is a fragmentary perspective view of the rear portion of the cleaner of FIG. 1.

The hose 20, which is capable of withstanding high pressure exerted by the water pump, is inserted into a sewer manhole or catch basin 25, and from there into a sewer lateral 26 to be cleaned. Water forced through the hose 20 under high pressure and outwardly of a nozzle 28 will drive the nozzle 28 into the lateral 26 and, because of rearwardly operating jets (not specifically shown), will pull the hose 20 from the reel 18. The reel 18, if desired, may include drive means (not shown) for feeding and rewinding the hose 20 into the lateral 26 at a controlled rate. As stated above, it is a principal object of this invention to provide operator protection because of the high pressure associated with application of cleaning water through the pressurized water hose 20. This object is partially accomplished by providing a hood-like, transparent, shatterproof shield 30 adapted to generally surround the area of the hose reel 18 to which the operator might be exposed during normal operation of the sewer cleaning machine 10 wherein fluids are pumped at high pressure. The shield, or enclosure 30 may be rigidly attached to the machine 12 or slidable from a storage position within the machine housing to an operating position externally of the housing as shown in FIG. 2. The shield 30 is preferably open at a side towards the reel and at its bottom, with sufficient room within the enclosure to accommodate a level winding device 31 adapted to swing horizontally from one side to another to permit the hose to be rewound on the reel with the convolutions being disposed adjacent to one another without lying across one another.

Figure 3:
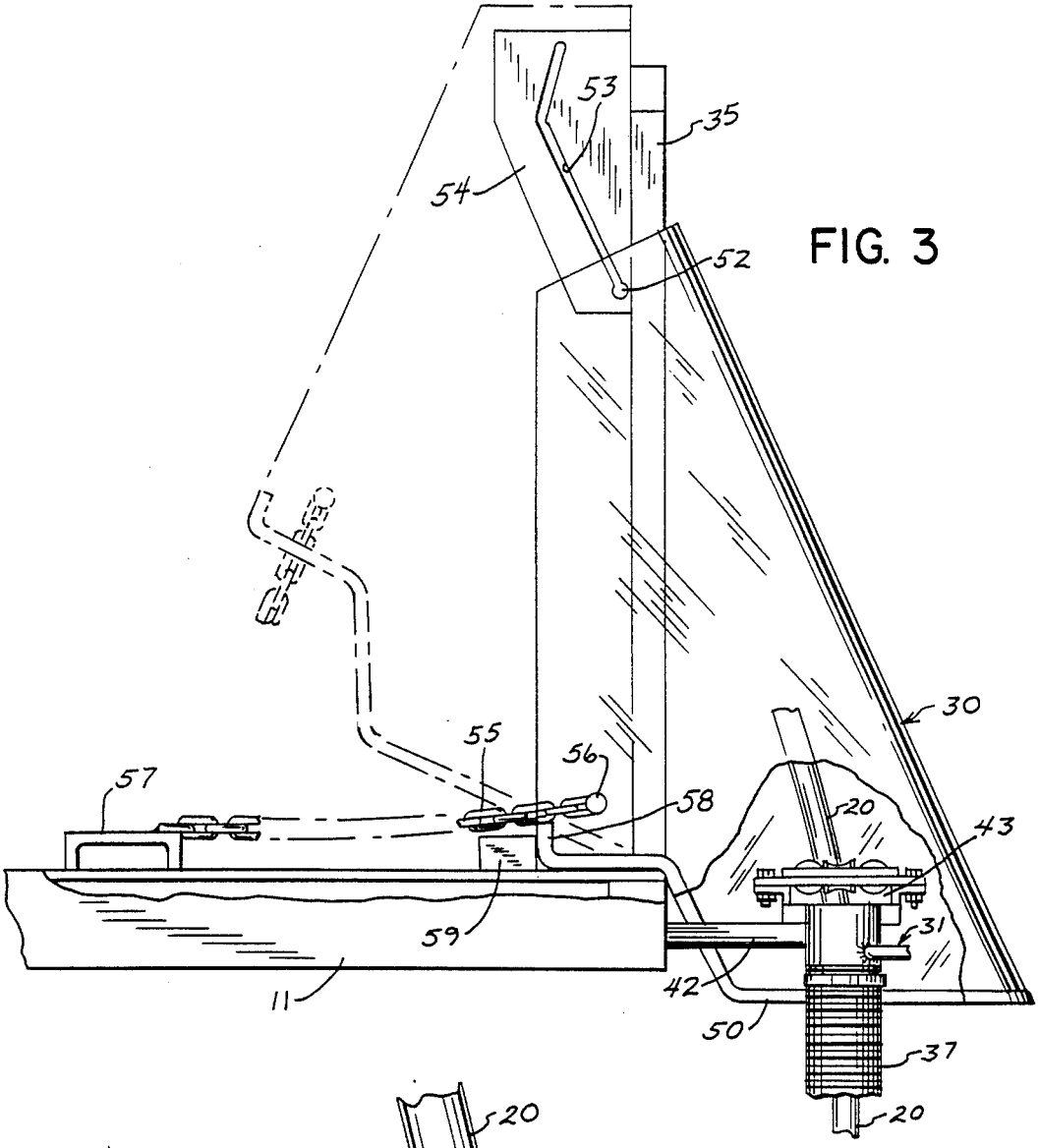
FIG. 3 is a fragmentary side elevational view of the protective device of the present invention with the back end portions of the water hose removed for clarity in assisting description.
Figure 4:
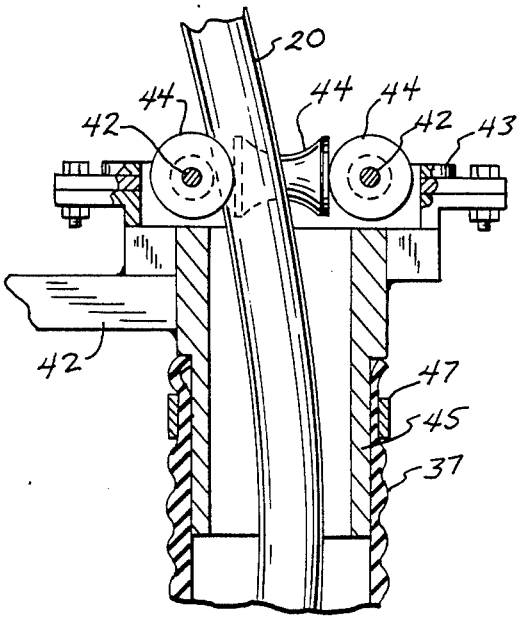
FIG. 4 is a fragmentary view, partially in section illustrating specific details of the support means for the protective sleeve or protective conduit of this invention.

With reference to FIGS. 2–4, inclusive, the details of the protective shielding means comprise a first portion in the form of the enclosure shield 30, preferably formed of a high strength, shatterproof transparent material such as Lexan manufactured by General Electric Company. Transparency is desirable in order for the operator to visibly observe the rewinding of the hose 20 on the reel 18 while operating the level winder 31. The shield 30 is generally formed as a "hood" or "shroud" for substantially protecting the operator from rupture of the hose 20, as will hereinafter be described. In general, the enclosure shield 30 provides a front face 32, parallel side faces 33 with the side faces being substantially triangular to permit ease in removing and insertion of the shield within the access opening 35 in the rear of the truck 11. The side of the shield 30 facing inwardly is left open to partially receive the flanges of the reel 18. The bottom of the shield 30 is left open to receive the lower protective portion of the shield member and to provide access to the supporting level winder when used, and for ease in placement of the hose within the lower protective portion.

The present invention contemplates the provision of a protective sleeve 37 to be used in conjunction with the transparent plastic enclosure shield 30.

The protective sleeve 37 is arranged to cover the exposed length of the high pressure hose 20 by extending a suitable length inwardly of the shield 30, and also in the vicinity of or inwardly of the mouth or entrance of the manhole or catch basin 25 to provide protection of the lower extremities of the operator.

The lower protective portion generally comprises an elongate, tough flexible conduit member, enclosure or sleeve 37 having a smooth bore of sufficient diameter or shape to freely slidably receive the pressurized water hose 20. The sleeve 37 has its upper end extending inwardly of the transparent shield 30 as shown in FIG. 3 and may be, as shown, supported by and moveable with the level winder 31. The protective sleeve 37 is supported at the distal end of a winder operating arm 42 extending through an aperture 45 of the truck body 11. The winder arm 42, is supported from a pivot support (not shown) located inwardly of the truck body 11. The level winder 31 is not always required, but it will be noted that the protective device of the present invention will accommodate a winder 31, as shown, and its pivotal swing from side to side. This arrangement permits the level winder arm 42 to be moved from side to side in a horizontal plane to insure that the hose 20 is rewound on the reel with no cross-over of adjacent coils or convolutions.

The hose 20 normally rests against a four-way roller or similar device 43 which may include rotatably supported rollers 44 disposed in a cruciform configuration and supported by stationary pins or axles 42. The roller device 43 is supported at the distal end of the winder arm 42 and includes an operating handle 45. The handle 46 is preferably L-shaped to extend upwardly and outwardly of the enclosure shield 30. For instance, the protective sleeve 37 may be formed of a wire supported, single ply nylon fabric reinforcement having a rubber cover and a rubber liner, such as the Type MH TUF-TEX® series manufactured by Thermoid, Inc. of Chanute, Kans. The protective conduit member or sleeve 37 is supported by the roller member 43, and receives an integral extending lower portion 45 of relatively reduced diameter. The sleeve 37 is secured in place on the tubular extension 45 by means of a hose clamp 47.

With particular reference to FIGS. 2 and 3, it will be observed that the enclosure shield 30 may be provided with a grooved vinyl channel 50 for protecting the lower marginal edge of the shield 30. The enclosure shield 30 is provided, at its upper end with attaching pins or inserts 52 respectively secured at both sides 33 thereof. The pins 52 are adapted to ride in the camming grooves or slots 53 formed in oppositely disposed stationary brackets 54 extending inwardly of the access opening 35. As will be observed from FIG. 3, the slot or groove 53 may be "hockey stick" shaped to provide a camming means for guiding and supporting the enclosure shield 30 from the shielding position shown in bold lines of FIG. 3 externally of the truck 11 and further steering or guiding the shield 30 as it is moved upwardly and inwardly to the storage position shown in phantom in FIG. 3 inwardly of the access opening 35. This attaching means for the enclosure shield 30 is set forth by way of example. There are other ways of supporting a shield (not shown), such as by means of folding linkage members, stationary attachment, etc. If desired, a suitable door (not shown) may be used to cover the opening 35 after the shield has been moved to its inward position.

Oppositely disposed utility chains 55 are fastened at both of the sides 33 of the shield 30 by means of attachment pins 56 seated in the respective sides 33 of the shield 30. The opposite ends of each chain 55 are fastened to a stationary channel-shaped member 57. Thus, the chains 55 hold the shield 30 in place as shown in the bold lines of FIG. 3 when in the extended or shielding position. The innermost end portions 58 of the shield 30 are arranged to rest against a stationary supporting block 59 mounted in the bed of the truck body 11.

Utility chains 55 are shown by way of example only and may be replaced with linkages, cables, etc. (not shown). Also, the shield 30 may be permanently mounted if so desired.

It will be apparent that operator protection is provided by the combined enclosure shield 30 and moveable protective conduit or sleeve 37 surrounding the hose 20, and which lower protective conduit 37 may be supported by the level winder 31 and its components 40, 42, 44 and 47.

Numerous other minor variations can be made by one skilled in the art after reading the foregoing specification. Thus, while the invention has been described in connection with the illustrated preferred embodiment, the invention is not to be limited thereby but is to be limited solely by the claims which follow.

What is claimed is:

1. In a sewer and/or catch basin cleaner of the type including a water injection system comprising a high pressure water hose, reel means supporting said hose and arranged to permit the hose to extend into and be withdrawn from a sewer catch basin or manhole, means for delivering water under pressure through said hose and means for protecting an operator from water hose or hose coupling failure, said protecting means including:

a first hood-like shield portion at least partially surrounding an upper exposed section of the water hose adjacent said hose reel;

a second elongate tubular portion for enclosing said water hose extending between said shield portion and said sewer catch basin or manhole and having a free end extending toward and communicating with the opening of the catch basin or manhole, the combined length of said first and second portions providing head-to-toe protection of the operator in case of hose or hose coupling rupture.

2. The cleaner of claim 1, wherein said second portion includes a section thereof extending downwardly through the opening of the catch basin or manhole.

3. The cleaner of claim 1, wherein said hood-like shield portion has at least three adjoining sidewalls and an open bottom, said second portion having its end opposite from said free end extending inwardly of the open bottom of said shield portion.

4. The cleaner of claim 3, wherein said first shield portion is transparent.

5. The cleaner of claim 3, wherein said first shield portion contains integrally formed front and oppositely disposed sidewalls defining an open side facing said reel means and an open bottom spaced from and facing said catch basin or manhole.

6. The cleaner of claim 3 further including a housing for said water injection system, an access opening in said housing receiving said reel means, and wherein said shield portion is pivotally supported for storage within said access opening.

7. The cleaner of claim 6, wherein said first shield portion contains integrally formed front and oppositely disposed sidewalls defining an open side facing said access opening and an open bottom spaced from and facing said catch basin or manhole.

8. The cleaner of claim 6, wherein said first shield portion is transparent.

9. The cleaner of claim 6, wherein opposed stationary brackets are mounted at opposite sides of said access opening and wherein each bracket contains a camming slot configured to slidably receive a cam member extending from opposite sides of said first shield portion to slidably support and guide said first shield portion into and out of said access opening.

10. The cleaner of claim 1 further including level winding means for said hose comprising an operating arm extending outwardly from said cleaner and laterally movable within the spacial area defined by said first shield portion and said tubular portion extending downwardly from the distal end of said operating arm.

11. The cleaner of claim 10, wherein the distal end of said operator arm includes smooth surfaced guide means for guiding and protecting said water hose.

12. The cleaner of claim 10, wherein the distal end of said operator arm further includes at least one rotatably supported roller for guiding and protecting said water hose.

13. Operator protection means for a sewer and/or catch basin cleaner of the type including a pressurized fluid-containing hose supported by and extending from said cleaner and arranged to extend into the entrance of a sewer or catch basin, said protection means comprising:

(a) a first protective portion comprising a hood-like shield supported from said cleaner and spaced from the entrance of said sewer or catch basin, said shield surrounding an upper portion of said hose; and (b) a second protective portion comprising a tubular sleeve surrounding said hose and having a sufficient length to extend from within said shield to said sewer or catch basin entrance;

whereby said portions cooperate to provide operator protection in the event of hose or coupling rupture.

14. The protection means of claim 13, wherein said tubular sleeve has a portion at one end extending inwardly of said shield and a portion at the opposite end extending downwardly through said sewer or catch basin entrance.

* * * * *